United States Patent [19]

Stromberg et al.

[11] Patent Number: 4,535,671

[45] Date of Patent: Aug. 20, 1985

[54] STICK TYPE DRUMSTICK

[76] Inventors: Paul C. Stromberg, 2417 Clinton Ave. South, Minneapolis, Minn. 55404; Van A. Luoma, 2800 West 42nd St., Minneapolis, Minn. 55410

[21] Appl. No.: 637,762

[22] Filed: Aug. 6, 1984

[51] Int. Cl.[3] ..... G10D 13/02

[52] U.S. Cl. ..... 84/422 S

[58] Field of Search ..... 84/422 S

[56] References Cited

U.S. PATENT DOCUMENTS 3,150,555 9/1964 Sage ..... 84/422

3,420,134 1/1969 Cordes ..... 84/422

4,200,026 4/1980 Phreaner ..... 84/422 S

*Primary Examiner*—Lawrence R. Franklin

*Attorney, Agent, or Firm*—C. G. Mersereau

[57] ABSTRACT

A stick type drumstick is disclosed which includes a plurality of elongated, substantially straight wooden rods disposed to form a bundle having two ends and a longitudinal axis and at least a first retainer is provided for securing the bundle tightly together in a band-like manner for a relatively short longitudinal span at a location spaced from but closer to the playing end thereof. A second retainer is provided for securing the bundle together at the handle end and an overlay sleeve may be provided on top of the retainer.

19 Claims, 6 Drawing Figures

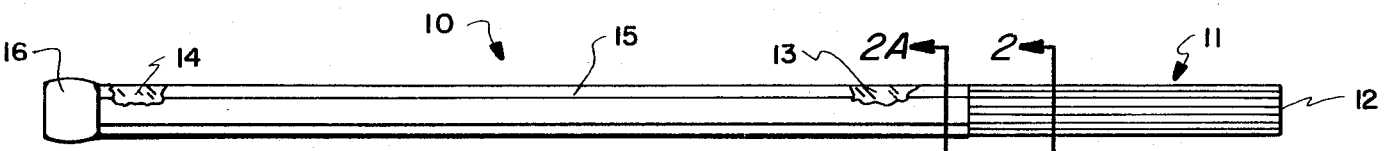
Fig. 1
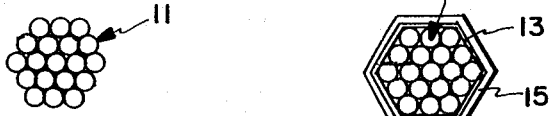
Fig. 2
Fig. 2A
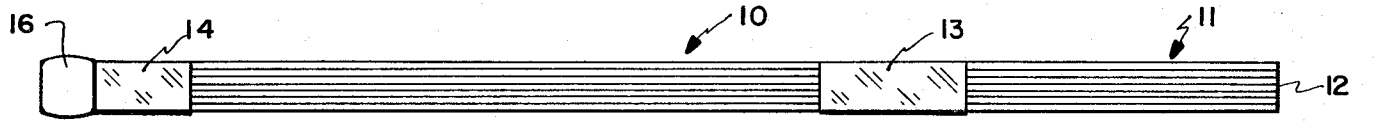
Fig. 3
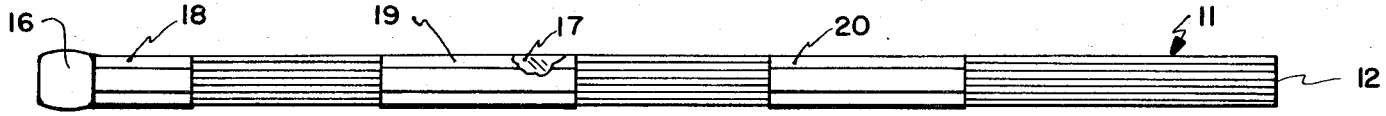
Fig. 4
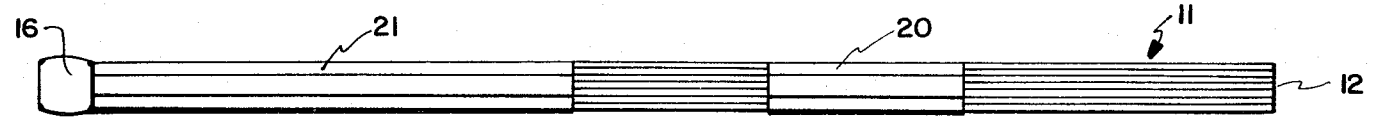
Fig. 5

STICK TYPE DRUMSTICK

BACKGROUND OF THE INVENTION

1. Field of the Invention

The present invention relates to drumsticks and, more particularly, to a unique wooden stick type drumstick with improved percussive characteristics.

2. Description of the Prior Art

In the prior art there have been two basic types of drumsticks. The brush type which typically produces a sweeping sound and the stick type which is used to produce a much stronger or more percussive sound. In the prior art stick type drumsticks were made of elongated round, generally cylindrical solid wood members that were tapered near both ends. One of the ends typically was in the shape of a ball-like head which was used to beat on the drum.

The brush type drumsticks were usually made up of a plurality of metal filaments secured to a handle. One improved embodiment of a brush type drumstick is shown in U.S. Pat. No. 4,200,026. That invention involves the use of a plurality of elongated plastic strands which are arranged in a tight bundle which is fixed at one end as by molding or fusing to form a handle. The plastic strands are free to spread out at the other end to achieve the brush sound when used. That drumstick, although an improvement over prior art brush sticks offers only limited use as a percussive stick owing to its basically soft and flexible nature.

There remains, however, a need in the stick drumstick art for a new and distinctive type of drumstick which offers an improved percussive sound which cannot be achieved by the prior art solid stick ball-head configuration.

SUMMARY OF THE INVENTION

By means of the present invention there is provided a new stick type drumstick which achieves improved percussive resonance and tonal qualities while retaining the rigidity required for the reverberation desired in loud drum passages. The drumstick of the present invention includes a bundle of elongated, substantially straight wooden rods which are preferably round hardwood rods such as dowels. The bundle is assembled with longitudinal axes parallel and bound or banded tightly together, as by a rigid plastic tape, for a relatively short span at a location spaced from but relatively closer to the playing or beating end. The rods at the handle end of the bundle are also retained tightly together. A sleeve or overlay retainer may then be applied over the drumstick from the handle end as far as the place where the rods are bound toward the playing end. The combination of the binding of the rods at a span spaced from the beating end and binding the other end at the handle yields a stick type drumstick which has the desired percussive strength, yet it is slightly flexible so that the combination including the interaction of the wooden rods among themselves when a drum is struck yields extraordinarily good tonal qualities.

BRIEF DESCRIPTION OF THE DRAWINGS

In the drawings wherein like numerals are used to depict like parts throughout the same:

FIG. 1 is a side view of a stick type drumstick constructed in accordance with one embodiment of the present invention;

FIG. 2 is an enlarged cross-sectional view along line 2—2 of FIG. 1;

FIG. 2A is an enlarged cross-sectional view along line 2A—2A of FIG. 1;

FIG. 3 is a side view depicting an alternate embodiment of the drumstick of the invention;

FIG. 4 is a side view of another embodiment of the invention; and

FIG. 5 is a side view of yet another embodiment of the invention.

DESCRIPTION OF THE PREFERRED EMBODIMENTS

FIG. 1 depicts an embodiment of a stick type drumstick 10 fabricated in accordance with the present invention. The drumstick includes a plurality of substantially straight elongated wooden rods 11 which are disposed to form a bundle, having a longitudinal axis the playing ends of which are preferable aligned in a substantially flat or planer playing end surface as at 12. The bundle of wooden rods is bound or banded tightly together over a relatively short portion or span of the bundle length toward the playing end as at 13 (see also FIG. 3) by a banding retainer such as a rigid cloth or plastic tape or the like. An example of this is ARMAK RJ-15 filament tape having a 185 lb. tensile strength, manufactured by the ARMAK Company. The handle end of the bundle is also tightly secured together by the same tape and/or by gluing a short span of the rods together as at 14. In addition an overlaying layer as sleeve 15 may be placed over the bundle to increase overall rigidity and facilitate handling of the drumstick. A cap 16 may be added if desired.

FIG. 3 shows an alternate embodiment in which the bundle of rods 11 having the substantially flat planer end surface is bound tightly together at 13 and 14 and also has a cap 16. In this embodiment the sleeve 15 is not used. In FIG. 4 another embodiment of the drumstick of the invention is shown in which an additional short intermediate span retainer is used between the handle and the retainer 13 as at 17. Instead of the one continuous sleeve 15 of FIG. 1, three shorter sleeves 18, 19 and 20 are used. The handle is also retained by glue as in FIG. 1.

Yet another embodiment is depicted in FIG. 5 in which an intermediate length sleeve 21 is employed together with the sleeve 20. In this embodiment the rods are retained under the sleeve as at 13 and 14 of FIG. 1 and optionally as at 17 of FIG. 4.

It will be appreciated that the wooden rods of the drumstick of the invention may be fabricated of any suitable hardwood which has the required degree of stiffness and resilience desired. Examples of possible woods include birch, oak, maple, ramin and ash, although it is contemplated that others will suffice as well. As shown in FIGS. 2, and 2A the preferable cross-sectional shape of the wooden rods is round and dowel material has been found to work quite well. The particular number of rods used may vary with the application and size of rods used. It has been found, however, that when 7 or 19 rods are used the cross-sectional of the bundle formed takes on a hexagonal geometry. This is convenient and desirable both from the standpoint of bundle symmetry and ease of gripping of the handle portion. The particular thickness of the rods also depends on the desired application. For example, it has been found that a bundle using 19, 1/16 inch diameter birch dowels, 16 inches long, works quite well. Another embodiment utilizes 7 rods of a larger diameter.

As previously discussed the intermediate retainers as at 13 and 17 may be any suitable fastening material such as plastic or cloth tape or the like or even metal if desired. The precise location of the retainer 13 is also dependent on the desired end stiffness or other considerations as is the particular span of the bundle encompassed by the retainer. This is selected along with wood, number of rods, and rod diameter. In the embodiment using the 19, 1/16 inch diameter birch dowels, for example, a 2-inch span of tape has been used for the retainer 13 which begins 4 inches from the playing end for a 16 inch long stick. It has been found that two thicknesses of the filament tape mentioned above works very successfully. The other retainers 14 and 17 have similarly been found to be successful as a double wrap of the 2 inch wide tape material.

The sleeve material may also be any material capable of causing a fairly rigid binding of the bundle of wooden rods. It is preferably a material which takes on the shape of the bundle such as the hexagonal shape mentioned above. This may be a material which is heat shrinkable such as a thin polyvinyl chloride (PVC) sleeve or the like. In the above example, a ⅝ inch diameter PVC sleeve having a 0.025 inch wall thickness was used. The handle end is preferably retained by dipping in a suitable glue for about the first one to two inches of length. While it is desirable that the rods be of equal length, the discrepancies in length can be compensated in the handle after the playing ends are aligned.

One successful embodiment has been fabricated by the procedure which follows. A bundle of 19, 1/16 inch diameter birch dowels 16 inches long were formed into a bundle, such that the playing ends were aligned to form a planer end surface. Two layers of tape 2 inches wide as at 13 of FIG. 1 were applied as a tight wrap starting at a point 4 inches from the playing end. This formed the bundle into a hexagonal shape. The handle end was then dipped in a liquid wood glue to a depth of about one and one half inches and allowed to dry. Next a double layer of tape was used to wrap the handle end of the bundle as at 14. A thin sleeve of ⅝ inch diameter heat-shrinkable polyvinyl chloride (PVC) having a thickness of about 0.025 inch was slipped over the hexagonally shaped bundle as at 15 (FIG. 1). Heat sufficient to shrink the sleeve to achieve a tight fit over the bundle of rods without injuring the wood or glue was applied to the sleeve. A decorative cap was then applied to the handle end over the sleeve.

Drumsticks fabricated in accordance with the present invention are slightly more flexible than solid wood sticks but much more rigid than the plastic brush sticks of the prior art. The interaction of the wooden rods among themselves when the stick strikes the drum adds desirable tonal qualities to the percussive sound of the drum which cannot be achieved with solid sticks or brush type plastic sticks. These tonal qualities may be varied by using a shorter sleeve as shown in the embodiment of FIG. 5 or by utilizing multiple wraps and short sleeves as shown in FIG. 4. As previously discussed, the width and location of the wraps, especially the wrap 13 also greatly affect tonal qualities.

It will also be appreciated that the use of relatively light weight plastic materials to bind the bundle and in the sleeve material is desirable to maintain proper stick balance. While other shapes are contemplated, the preferred hexagonal cross-sectional configuration has also been found to be very desirable for gripping the stick.

The embodiments of the invention in which an exclusive property or right is claimed are defined as follows:

1. A stick type drumstick comprising:

a plurality of elongated, substantially straight wooden rods disposed to form a bundle, said bundle having two ends and a longitudinal axis;

first retaining means securing said bundle tightly together in a band-like manner for a relatively short longitudinal span at a location spaced from but closer to the playing end thereof; and second retaining means securing said bundle together at the handle end thereof.

2. The drumstick of claim 1 further comprising third retaining means binding said bundle tightly together in a band-like manner for a relatively short longitudinal span at a location between said first and said second retaining means.

3. The drumstick of claim 1 further comprising overlay retaining means for binding said bundle together, said overlay retaining means enveloping said bundle and extending from the handle end of the bundle to the point inclusive of said third retaining means.

4. The drumstick of claim 3 wherein said overlay retaining means extends from said handle end of the bundle to a point inclusive of said first retaining means.

5. The drumstick of claim 4 wherein said overlay retaining means comprises a heat shrinkable sleeve.

6. The drumstick of claim 5 further comprising third retaining means binding said bundle tightly together in a band-like manner for a relatively short longitudinal span at a location between said first and said second retaining means.

7. The drumstick of claim 3 wherein said overlay retaining means comprises a heat shrinkable sleeve.

8. The drumstick of claim 1 wherein said wooden rods are round in crossection.

9. The drumstick of claim 8 wherein the number of said rods is such that when bundled together, the drumstick acquires a substantially hexagonal cross-sectional shape.

10. The drumstick of claim 9 wherein the number of said rods is 19.

11. The drumstick of claim 1 wherein said first and said second retaining means comprise plastic tape.

12. The drumstick of claim 1 wherein said wood is hardwood.

13. The drumstick of claim 12 wherein said hardwood is one selected from the group consisting of birch, maple, ramin, oak and ash.

14. The drumstick of claim 1 wherein the playing end of the bundle of wooden rods are aligned to form a substantially planer surface perpendicular to said longitudinal axis.

15. The drumstick of claim 1 where said second retaining means includes an amount of glue.

16. A stick type drumstick comprising:

a plurality of elongated, substantially straight hardwood rods, said rods being of substantially round crossection disposed together in parallel to form a bundle having a longitudinal axis and two ends wherein the ends of the rods are substantially aligned to form a substantially planer playing end, the other end being a handle end;

first retaining means for binding said bundle together in a band-like manner for a relatively short longitudinal span at a location spaced from but closer to said playing end;

second retaining means securing said bundle together at the handle end thereof; and overlay retaining sleeve means enveloping the bundle on top of each of said first and second retaining means.

17. The drumstick of claim 16 wherein the number of rods is such that when bundled together, the drumstick acquires a substantially hexagonal cross-sectional shape.

18. The drumstick of claim 17 wherein the number of rods is 19.

19. The drumstick of claim 17 wherein the number of rods is 7.

* * * * *